United States Patent [19]

Triplett et al.

[11] Patent Number: 4,712,348

[45] Date of Patent: Dec. 15, 1987

[54] NON-PENETRATING ROOF SYSTEM

[76] Inventors: Charles S. Triplett, 1520 Fairway Ct., Fort Wayne, Ind. 46825; John D. Gray, R.R. #2, Avilla, Ind. 46710

[21] Appl. No.: 873,958

[22] Filed: Jun. 13, 1986

[51] Int. Cl.[4] ..... E04B 7/00; E04B 5/00

[52] U.S. Cl. ..... 52/408; 52/410; 52/746; 52/512

[58] Field of Search ..... 52/63, 96, 222, 309.8, 52/404, 408, 512, 410, 417, 513, 515; 206/813; 156/71

[56] References Cited

U.S. PATENT DOCUMENTS

| | | | |
|---|---|---|---|
| 1,376,215 | 4/1921 | Millard | 206/813 |
| 2,896,271 | 7/1959 | Kloote et al. | 52/417 |
| 3,455,077 | 7/1969 | Long | 52/417 |
| 3,671,371 | 6/1972 | Wolf | 156/71 |
| 4,045,922 | 9/1977 | Elliott | 52/408 |
| 4,161,854 | 7/1979 | Stelzer | 52/515 |
| 4,223,487 | 9/1980 | St. Clair | 52/309.8 |
| 4,382,353 | 5/1983 | Kelly | 52/404 |
| 4,424,650 | 1/1984 | Van Note | 52/96 |
| 4,441,295 | 4/1984 | Kelly | 52/309.8 |
| 4,519,172 | 5/1985 | Ristow | 52/410 |

*Primary Examiner*—James L. Ridgill, Jr.
*Attorney, Agent, or Firm*—Lundy and Walker

[57] ABSTRACT

A non-penetrating roof structure or system and method comprising a roof deck, a plurality of retainers connected to the roof deck between the margins thereof, and a cover membrane extending over the roof deck and the retainers. The cover membrane is generally flexible. A kit for connecting the cover member to the roof deck comprising the battans and retainers is also provided. The cover membrane is affixed to the deck at the margins and connected to the roof deck between the margins by the retainers. The cover member is imperforate over the retainers and the deck.

23 Claims, 2 Drawing Figures

NON-PENETRATING ROOF SYSTEM

BACKGROUND OF THE INVENTION

The present invention pertains to roof structure or systems and methods for producing roof structure or systems and more particularly to roof structure or systems utilizing a flexible cover membrane.

Roof structure or systems have long attempted to provide imperviousness to water and wind and weather resistance. These qualities have always been difficult to achieve with flat roofs or roofs with little pitch. Some past roof structure or systems have relied on strips of sheet material affixed by hot tar. These structure or systems have a number of shortcomings the most noteworthy of which is the considerable risk of setting the building on fire if proper precautions are not taken. In other structure or systems hot tar is replaced with an adhesive, however, using adhesive over an entire roof is expensive. In other roof structure or systems, sheet material is held in place by holddowns which extend through the sheet material and into the roof base. Roof structure or systems of this type have the shortcoming that each holddown is a potential site for water leakage through the hole in the sheet material necessitated by the holddown.

Additionally, none of the prior art roof structure or systems will pass the I90 wind uplift standard of Factory Mutual Insurance Company.

It is therefore highly desirable to provide an improved roof structure or system and an improved method for producing a roof structure or system.

It is also highly desirable to provide an improved roof structure or system and an improved method for producing a roof structure or system which does not include holddowns extending through the cover membrane.

It is also highly desirable to provide an improved roof structure or system and an improved method for producing a roof structure or system which does not include an adhesive spread over the entire roof deck.

It is also highly desirable to provide an improved roof structure or system and an improved method for producing a roof structure or system which complies with the I90 wind uplift of Factory Mutual Insurance Company standard.

It would finally be highly desirable to provide an improved roof structure or system and an improved method for producing a roof structure or system which meets all of the above-desired features.

SUMMARY OF THE INVENTION

It is an object of the invention to provide an improved roof structure or system and an improved method for producing a roof structure or system.

It is also an object of the invention to provide an improved roof structure or system and an improved method for producing a roof structure or system which does not include holddowns extending through the cover membrane.

It is further an object of the invention to provide an improved roof structure or system and an improved method for producing a roof structure or system which does not include an adhesive spread over the entire roof deck.

It is an object of the invention to provide an improved roof structure or system and an improved method for producing a roof structure or system which complies with the I90 wind uplift standard of Factory Mutual Insurance Company.

It is finally an object of the invention to provide an improved roof structure or system and an improved method for producing a roof structure or system which meets all of the above-desired features.

In the broader aspects of the invention there is provided a non-penetrating roof structure or system and method comprising a roof deck, a plurality of battans connected to the roof deck between the margins thereof, and a cover membrane extending over the roof deck and the battans. The cover member is generally flexible. A kit for connecting the cover member to the roof deck comprising the battans and retainers is also provided. The cover member is affixed to the deck at the margins and connected to the roof deck between the margins by the retainers. The cover member is imperforate over the retainers.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings wherein.

FIG.. 1 is a cross-sectional view of the roof structure or system of the invention installed on a roof deck.

DESCRIPTION OF A SPECIFIC EMBODIMENT

Figure 1:
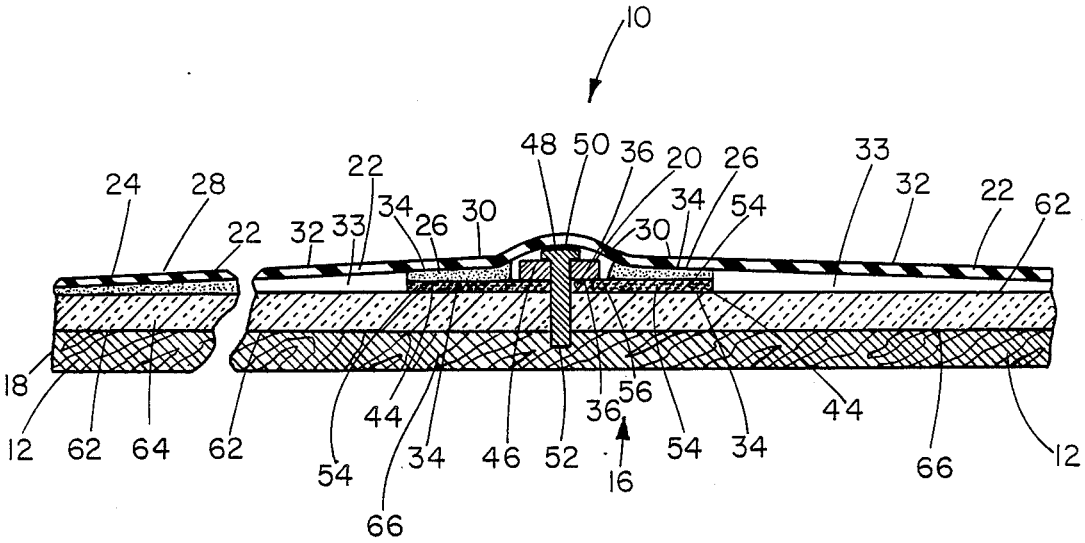
Figure 2:
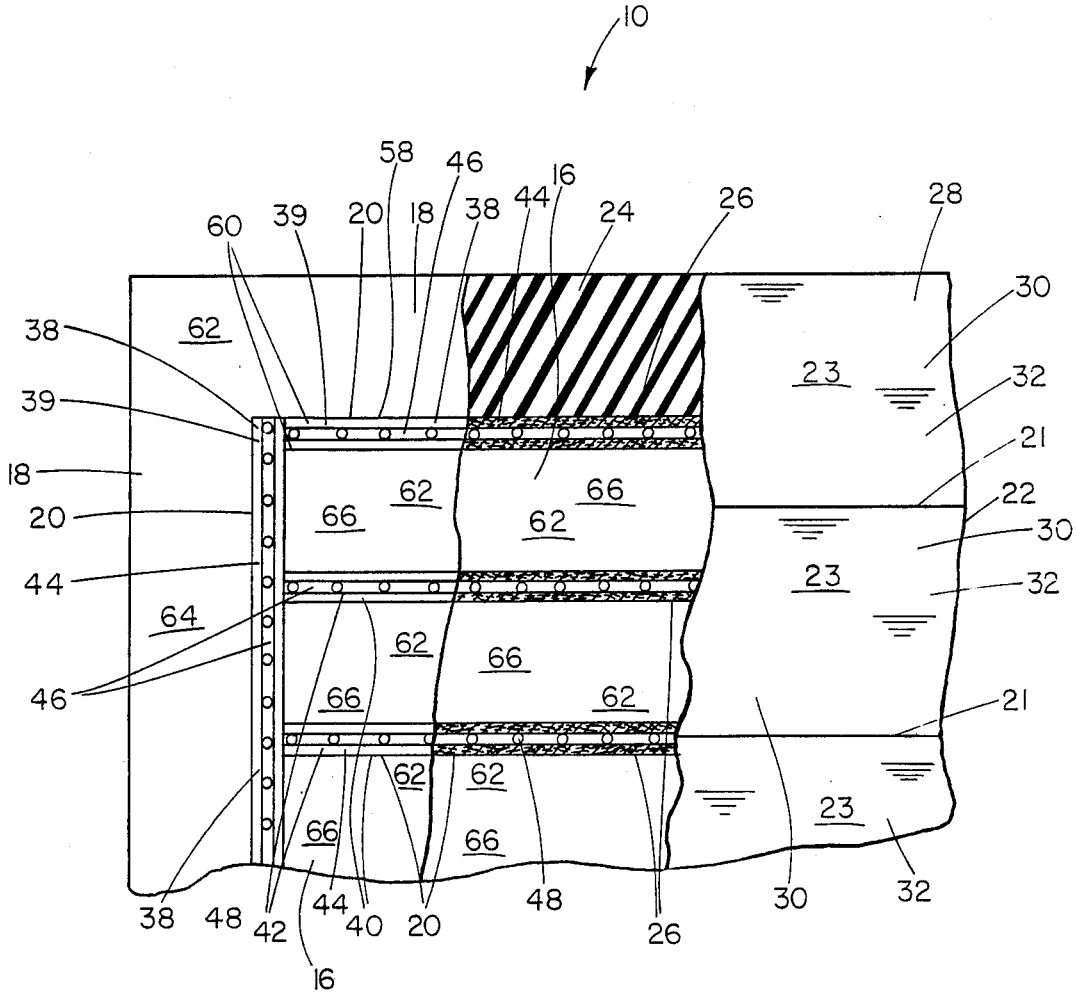
FIG. 2 is a fragmentary top plan view of a portion of the roof structure or system of FIG. 1.

The roof structure or system 10 of the invention overlays a roof deck or base 12 of a structure. The roof deck 12 usually comprises sheet material supported by rafters of wood, but could be of metal, concrete, or some other material. The roof deck 12 has a central portion 16 and margins 18. The roof system 10 of the invention has retainers 20 disposed within the central portion 16 of the roof deck 12 which connect the cover membrane 22 to the roof deck 12. The cover membrane 22 extends over the retainers 20 and the roof base 12 and, is flexible and impervious to water or waterproof. The cover membrane 22 is imperforate over the retainers 20 and roof deck 12. A number of different materials may be used for the cover membrane 22. It is preferable that the cover membrane 22 be in sheet form as either a single piece 23 or a number of pieces 23 joined together at the seams 21. In a specific embodiment of the roof system 10 of the invention, the material of the cover membrane 22 is vulcanized ethylene propylene diene monomer (EPDM) compounded elastomer having a thickness between about 0.035 mil and 0.100 mil. Two commercially available thicknesses in this range are 0.045 mil and 0.060 mil.

The cover membrane 22 is affixed at the margins 18 of the roof base 12. It is preferable that the cover membrane 22 be bonded to the margins 18 by adhesive 24. It is preferable that the layer of adhesive 24 be continuous. The cover membrane 22 is also connected to the retainers 20 by bonding cover membrane 22 to the retainers 20 by bonding material 26. Thus, the cover membrane 22 has margin sections 28 attached to margins 18, retainer sections 30 attached to retainers 20, and free sections 32 which are not attached to the retainers 20 or the margins 18. Wind uplift of free sections 32 may define spaces 33 between the free sections 32 and the roof deck 12.

The retainers 20 have movable portions 34 and fixed portions 36. Both fixed portions 36 and movable portions 34 are bonded to the retainer sections 30 of the cover membrane 22 by adhesive 26. The movable portions 34 are not bonded to roof deck 12 and can deflect away from the roof deck 12.

In a specific embodiment of the invention, the retainers 20 include border retainers 38, forming borders 39 which surround the central portion 16 of the roof deck 12 and adjoin margins 18, and row retainers 40, forming rows 42 which are spaced apart from the borders 39 in a lateral direction and adjoin the borders 39 in a longitudinal direction. If protrusions, such as vent pipes, chimneys and the like, extend through the flat portion 14 of roof deck 12, retainers 20 are positioned around the protrusions in addition to being disposed at edges 39 and rows 42. In a preferred embodiment of the invention, which passes the I90 standard of Factory Mutual Insurance Company, the margins extend a width of about six feet and the rows 42 are separated from each other by a distance of about six feet.

The retainers 20 include retention sheets 44 and battans 46. The battans 46 are fastened to the roof deck 12. In a preferred embodiment of the roof system 10 of the invention, the battans 46 are attached to the roof base 12 by fasteners 48. In that embodiment the fasteners 48 each have a head 50 and a shank 52. The shanks 52 extend through holes in the battans 46 and the retention sheets 44 into the roof base 12. The heads 50 bear upon the battans 46, and hold then snugly against the deck 12 with the sheets 44 therebetween.

The retention sheets 44 are essentially flexible, and preferrably are composed of light, strong and pliable fabric such as woven glass or polyester fiber material. The battans 46 are substantially rigid and preferrably are metal bars. In a specific embodiment, the battans 46 have as their two smaller dimensions a width of about 1 inch and a thickness of about 1/16 inch, and the retention sheets 44 have a width of about 1 foot.

The retention sheets 44 have outer portions 54 and inner portions 56. The inner portions 56 are disposed between the battans 46 and the roof deck 12. In a specific embodiment in which the retainers 20 include fasteners 48, the retention sheets 44 are held in place against the roof deck 12 by the battans 46. The outer portions 54 of the retention sheet 44 are adhesively secured to the cover membrane 22 and are thus made integral. The retention sheets 44 are generally rectangular and have longitudinal ends 58 and lateral sides 60 and battans 46 are disposed longitudinally on retention sheets 44. In that embodiment, retention sheets 44 are overlaid by battans 46 from end 58 to end 58, however, the number of retention sheets 44 and battans 46 may differ depending on their length. One retention sheet 44 may be overlaid by a sequence of battans 46 or one battan 46 may overlay a sequence of retention sheets 44. In row and border retainers 38, 40, battans 46 are disposed centrally on retention sheets 44 and each border retainer 38 thus has a pair of movable portions 34 and a fixed portion 36. If protrusions extend through the flat portion 14 of roof base 12, the battans 46 surrounding the protrusions are disposed on the retention sheets 44 adjacent the protrusions and each retainer 20 has only one movable portion 34.

The roof structure or system 10 of the invention complies with the I90 standard of Factory Mutual Insurance Company. A specific embodiment which meets this standard has a cover membrane 22 of 0.045 or 0.060 mil thick vulcanized ethylene propylene diene monomer compounded elastomer bonded to 6 foot wide margins and to 1 foot wide retention sheets 44 held down by 1 inch wide and 1/16 inch thick battans having fastener holes spaced 12 inches on center and fasteners 48 penetrating the roof base 12 to a depth of at least 1 inch. The retainers 20, in that embodiment are disposed in borders 39 and in rows 42. The rows 42 are spaced apart from each other and parallel borders 39 by a distance of about 6 feet.

The roof structure or system 10 of the invention may include insulation 62 superimposed on the roof base 12 under the retainers 20. The retainers 20 are fastened to the roof base 12 through the insulation 62. The margin sections 28 of cover membrane 22 are bonded or otherwise fastened to outer insulation 64 overlaying the margins 18. The outer insulation 64 is attached to the roof base 12 in compliance with wind uplift requirements desired for the roof structure or system 10 as a whole.

The roof system 10 of the invention may also include conventional flashing and perimeter treatments as desired.

In operation, the retention sheets 44 move with the cover membrane 22 under the influence of wind. In so doing the cover membrane may take the form of ballooning pillows between retainers 20. Despite ballooning, the roof structure or system 10 of the invention does not lift off the roof deck 12 within the limits of wind uplift of the particular embodiment of the roof structure or system 10. An explanation can be proposed for this effect: that the roof system 10 of the invention holds the cover membrane 22 to the retention sheets 44 in shear rather than peel with a strength that exceeds the pull out strength of the fasteners 48. This explanation, however, is not intended to limit the invention as claimed.

In the method of the invention, retainers 20 are connected to a roof base 12 at spaced apart intervals within the central portion 16 of a roof base 12. A generally flexible cover member 22 is placed over the roof base 12 and retainers 20. The cover membrane 22 is secured at margins 18 to the roof base 12 by adhesive. The cover membrane 22 is also secured to the retainers 20 by adhesive.

Retainers 20 are connected to roof base 12 as follows. Retention sheets 44 are placed on the roof deck 12 battans 46 are placed on the retention sheets 44 and the battans 46 are fastened to the roof deck 12 through the retention sheets 44. A kit is provided for connecting cover membrane 22 to roof base 12. The kit comprises retention sheets 44 and battans 46.

While a specific embodiment of the invention has been shown and described herein for purposes of illustration, it is desired that the protection afforded by a patent which may issue upon this application not be limited strictly to disclosed embodiments; but that it extend to all structures and arrangements which contain the essence of the invention and which fall fairly within the scope of the claims which are appended hereto.

What is claimed is:

1. A roof structure comprising roof base, a plurality of flexible retention sheets, said retention sheets having inner and outer portions, a plurality of battans, said battans being positioned on said inner portions of said retention sheets and being secured to said base, said inner portions being between said battans and said base, said outer portions being on opposite sides of said battans and being moveable toward and away from said base, and a flexible imperforate cover membrane overlaying said battans and retention sheets, said membrane being bonded to said outer portions and secured to said roof base at its periphery, whereby said bonded membrane and retention sheet portions are integral.

2. The structure of claim 1 wherein said cover membrane is imperforate over the entire upwardly facing surface of said roof base.

3. The roof structure of claim 1 wherein said retention sheets are woven fabric chosen from the group consisting of glass and resin materials.

4. The roof structure of claim 1 wherein the total longitudinal dimension of said battans is about the same as the total longitudinal dimension of said retention sheets.

5. The roof structure of claim 1 further comprising insulation, said insulation being superimposed on said roof base under said battans and retention sheets, said battans and retention sheets being connected to said roof base through said insulation.

6. The roof structure of claim 1 wherein said cover membrane is vulcanized ethylene propylene diene monomer compounded elastomer.

7. The roof structure of claim 1 wherein said retention sheets are generally rectangular and wherein said battans are elongated and wherein said battans are disposed longitudinally on said retention sheets.

8. The structure of claim 7 wherein said retention sheets and battans are disposed on said roof base between its periphery in a plurality of spaced apart rows extending between opposite portions of said periphery whereby said cover membrane is secured to said roof base between said periphery by said outer retention sheet portions.

9. A kit for connecting a flexible membrane to a flat base comprising a plurality of flexible retention sheets, said retention sheets having inner and outer portions, a plurality of battans said battans being positioned on said inner portions of said retention sheets, said battans being adapted to be secured to said base, said outer portions being on opposite sides of said battans, said retention sheets being between said battans and said base and being moveable toward and away from said base when secured to said base by said battans, said outer portions having upwardly facing surfaces adapted to be coated with adhesive for bonding said outer portions and said membrane into an integral sheet.

10. The fastening structure of claim 9 wherein said retention sheets are woven fabric chosen from the group consisting of glass and resin materials.

11. The fastening structure of claim 9 wherein said retention sheets are generally elongated rectangular strips of sheet material, said battans are elongated, said battans are disposed longitudinally on said retention sheets.

12. The fastening structure of claim 9 wherein the total longitudinal dimension of said battans is about the same as the total longitudinal dimension of said retention sheets.

13. The fastening structure of claim 9 wherein the cover membrane is imperforate over the entire upwardly facing surface of said base.

14. The fastening structure of claim 9 wherein said retention sheets and battans are disposed on said base between its periphery in a plurality of spaced apart rows extending between opposite portions of said periphery, whereby said cover membrane is secured to said roof base between said periphery by said outer retention sheet portions.

15. A roofing method comprising overlaying base with a flexible retention sheet, said retention sheet having inner and outer portions, overlaying said inner portion of said retention sheet with a battan, securing said battan to said base, said outer portions being on opposite sides of said battan and being moveable toward and away from said base, overlaying said retention sheet and battan with a flexible, imperforate membrane, and bonding said membrane and outer portions together, whereby said bonded membrane and retention sheet portions are integral.

16. The method of claim 15 wherein both said retention sheet and battan are provided in a plurality, said overlaying steps are performed so as to position said retention sheets and battans on said base between its periphery in a plurality of spaced apart rows extending between opposite portions of said periphery, and wherein said membrane is secured to said base between its periphery by said outer retention sheet portions.

17. The method of claim 15 wherein said cover membrane is imperforate over the entire upwardly facing surface of said base.

18. The method of claim 15 wherein said retention sheets are woven fabric chosen from the group consisting of glass and resin materials.

19. The method of claim 15 wherein said retention sheets are generally elongated strips of sheet material, said battans are elongated, said battans are disposed longitudinally on said retention sheets.

20. The method of claim 15 wherein the total longitudinal dimension of said battans is about the same as the total longitudinal dimension of said retention sheets.

21. The roof system of claim 15 wherein said retention sheets are woven fabric chosen from the group consisting of glass and resin materials.

22. The roof system of claim 15 wherein said retention sheets are elongated rectangular strips of sheet material said battans are elongated, said second overlaying step further comprises positioning said battans longitudinally on said retention sheets.

23. The roof system of claim 15 further comprising superimposing insulation on said roof base prior to connecting said retainers to said roof base.

* * * * *